United States Patent [19]

Sakano et al.

[11] 4,179,341

[45] Dec. 18, 1979

[54] METHOD FOR PREPARATION OF A PLATED PRODUCT

[75] Inventors: Hajime Sakano, Hirakata; Shigemitsu Kawagishi, Kadoma; Mikio Kodama, Takatsuki; Akitoshi Ito, Yao; Toshihiro Shoji, Amagasaki; Miyuki Terada, Amagasaki; Isao Yoshida, Amagasaki, all of Japan

[73] Assignee: Sumitomo Naugatuck Co., Ltd., Japan

[21] Appl. No.: 914,824

[22] Filed: Jun. 12, 1978

[30] Foreign Application Priority Data

| | | | |
|---|---|---|---|
| Jun. 10, 1977 | [JP] | Japan | 52-69013 |
| Jun. 14, 1977 | [JP] | Japan | 52-70179 |
| Aug. 1, 1977 | [JP] | Japan | 52-92775 |

[51] Int. Cl.[2] ..... C25D 5/56

[52] U.S. Cl. ..... 204/20; 204/30

[58] Field of Search ..... 204/20, 30

[56] References Cited

U.S. PATENT DOCUMENTS

| | | | |
|---|---|---|---|
| 2,551,342 | 5/1951 | Scholl | 204/30 |
| 2,776,253 | 1/1957 | Scholl | 204/30 |
| 3,416,992 | 12/1968 | Amos | 204/30 |
| 3,865,699 | 1/1975 | Luch | 204/20 |
| 4,002,595 | 1/1977 | Adelman | 204/30 |

FOREIGN PATENT DOCUMENTS

| | | | |
|---|---|---|---|
| 48-14188 | 4/1973 | Japan | 204/30 |

*Primary Examiner*—T. M. Tufariello

*Attorney, Agent, or Firm*—Jones, Tullar & Cooper

[57] ABSTRACT

A method for preparation of a plated product which comprises electroplating a molded product of a resin composition comprising at least one kind of thermoplastic resin and carbon black having an oil absorption amount of not less than 200 ml/100 g and a surface area of not less than 500 $m^2/g$ in a weight proportion of 100:3–100 and having an intrinsic volume resistivity of not more than $10^3$ Ω.cm without previous electroless plating.

23 Claims, No Drawings

METHOD FOR PREPARATION OF A PLATED PRODUCT

The present invention relates to a novel method for preparation of a plated product. More particularly, it relates to a method for electroplating a molded product of a resin composition comprising a thermoplastic resin and carbon black without previous electroless plating.

Hitherto, plastic resins are used as materials for manufacture of plated products in various fields, because of their good moldability and light weight. Especially, a copolymer comprising vinyl cyanide, an aromatic vinyl compound and a conjugated diene rubber is widely used as a plastic material for plating due to its excellent appearance and performances. Since, however, these plastic resins are not electroconductive, they cannot directly be electroplated and are required to be made electroconductive prior to electroplating. Thus, the electroplating of a molded product of a plastic resin can be accomplished only after pretreatment, which is carried out through the following lengthy series of steps: surface adjusting, degreasing, etching, activating-sensitizing (or catalyst treatment-activator treatment) and electroless plating. For instance, a molded product of a plastic resin is first subjected to surface adjustment for removal of flaw, flash, etc. on the surface of the molded product. Then, the molded product is degreased so as to remove oil stains and the like adhered thereon. The degreased product is then etched with an etching solution such as sulfuric acid-chromic acid, followed by neutralization. The resulting product is sensitized, for example, by treatment with a solution of stannous chloride and activated, for example, by treatment with a solution of palladium chloride. In alternative, these treatments may be effected in a single step, for instance, by the use of a solution of palladium chloride containing stannous ion. Then, the resultant product is subjected to electroless plating by a conventional manner so as to form a coating film of copper, nickel, chromium or the like.

As understood from the above, the electroplating of a molded product of a plastic resin according to a conventional procedure necessitates a lengthy series of steps for pretreatment. In those steps, various chemicals are used, and their discard causes serious pollution problem.

As the result of the extensive study, it has now been found that the use of a certain thermoplastic resin composition makes it possible to omit at least a part of the steps for pretreatment, particularly the step for electroless plating, on the electroplating of a molded product of such composition. The present invention is based on this finding.

Accordingly, a basic object of the present invention is to provide a molded product of a resin composition which can be electroplated without previous electroless plating. Another object of this invention is to provide a method for electroplating a molded product of a resin composition without previous electroless plating. A further object of the invention is to provide a method for preparation of an electroplated molded product of a resin composition without electroless plating. These and other objects of the invention will be apparent to those skilled in the art from the foregoing and subsequent descriptions.

The resin composition of the present invention comprises at least one thermoplastic resin and carbon black having an oil absorption amount of not less than 200 ml/100 g and a surface area of not less than 500 $m^2/g$ (when determined by the nitrogen adsorption method) in a weight proportion of 100:3–100 and has an intrinsic volume resistivity of not more than $10^3$ Ω.cm.

As the thermoplastic resin, there may be employed copolymers of vinyl cyanide, aromatic vinyl compounds and conjugated diene rubbers, homopolymer and copolymers of vinyl chloride, homopolymer and copolymers of styrene, polyphenylene oxides, polycarbonates, polysulfones, polyesters, polyacetals, polyamides, polyalkylenes (e.g. polyethylene, polypropylene), methacrylic resins, aromatic vinyl compound-vinyl cyanide resins, ethylene-vinyl acetate resins, etc. Among them, particularly preferred is acrylonitrile-styrene-conjugated diene rubber (e.g. polybutadiene, styrene-butadiene copolymer, acrylonitrile-butadiene copolymer). These thermoplastic resins may be used alone or in combination. When they are used in combination, their compatibility should be taken into consideration. Examples of the combination which shows a good compatibility are as follows: a mixture of polyphenylene oxide and polystyrene, a mixture of polyethylene and polypropylene, a mixture of a copolymer of vinyl cyanide, an aromatic vinyl compound and a conjugated diene rubber with one or more resins such as homopolymer and copolymers of vinyl chloride, polyphenylene oxides, polycarbonates, polysulfones, polyacetals, methacrylic resins and aromatic vinyl compound-vinyl cyanide resins. In case of two or more kinds of thermoplastic resins being used in combination, their proportions may be appropriately decided depending on their kinds; for instance, a copolymer of vinyl cyanide, an aromatic vinyl compound and a conjugated diene rubber may be used with one or more of the above mentioned resins in a weight proportion of 1:99 to 99:1.

The carbon black to be used in the present invention has an oil absorption amount of not less than 200 ml/100 g and a surface area of not less than 500 $m^2/g$. The use of any carbon black which does not satisfy the said requirements can not afford an electroplated film of good quality. The carbon black is to be employed in an amount of 3 to 100 parts by weight, preferably of 5 to 70 parts by weight and more preferably of 8 to 25 parts by weight, to 100 parts by weight of the thermoplastic resin. When the amount is less than the said lower limit, an electroplated film of good quality is not obtainable. When the amount is more than the said upper limit, the physical properties of the molded product resulting from the resin composition is considerably deteriorated.

The term "oil absorption amount" as used hereinabove indicates the amount (ml) of dibutyl phthalate absorbed in 100 grams of carbon black when determined by the use of an absorptometer according to the method as described in JIS (Japanese Industrial Standard) K-6221-1975. The term "surface area" indicates the area ($m^2$) of one gram of carbon black when determined using nitrogen according to the method as described in ASTM (American Society for Testing and Materials) D 3037-73.

The resin composition of the invention is obtainable by admixing the thermoplastic resin with the carbon black uniformly. In addition to these essential components, any other additive such as lubricants, antioxidants, plasticizers and fillers may be incorporated therein. The formation of a molded product from the resin composition may be achieved by a conventional shaping procedure. The resin composition is required to have an intrinsic volume resistivity of not more than $10^3$ Ω.cm, preferably of not more than $10^2$ Ω.cm. When this value is over the said limit, a satisfactory electroplated film may be hardly formed. The term "intrinsic volume resistivity" as hereinabove used is intended to mean a value obtained by measurement according to the method as described in BS (British Standard) 2044 (Method 2).

The molded product of the resin composition of the invention can be successfully electroplated without previous electroless plating. Thus, the step for electroless plating and, if desired, any other step(s) in the pretreatment can be omitted. For instance, the molded product may be etched, and then subjected to electroplating. Further, for instance, it may be etched, activated and sensitized, and then subjected to electroplating. Each of these treatments including electroplating may be performed in a per se conventional manner. The thus formed electroplated film adheres firmly on the molded product as the substrate and shows good appearance and satisfactory physical properties.

As understood from the above descriptions, the present invention makes it possible to omit at least the step for electroless plating from a conventional method for electroplating a plastic material. This is quite advantageous in saving the costs for treating reagents and their handling. Further, the control of the production steps is much simplified. In addition, etching may be accomplished by the use of an etching solution having a low concentration of chromium ion, which is highly advantageous from the viewpoint of prevention of an environmental pollution problem.

Practical and presently preferred embodiments of the present invention are illustratively shown in the following Examples wherein parts and % are by weight unless otherwise indicated. The term "ABS resin" is intended to mean a styrene-acrylonitrile-polybutadiene copolymer.

EXAMPLE 1

As an ABS resin there is used Kralastic ® MV (made by Sumitomo Naugatuck Co., Ltd.). This ABS resin (100 parts) and a carbon black having an oil absorption amount of 350 ml/100 g and the surface area of 1000 $m^2/g$ (15 parts) are kneaded with a Banbury mixer at 220° C. for 12 minutes to give a composition having an intrinsic volume resistivity of 17 Ω.cm. From this composition a flat plate (70 mm×140 mm×2 mm) is molded.

The flat plate is degreased with a C-15 cleaner solution made by Okuno Chemical Industry Co., Ltd., subjected to etching with an etching solution of chromic anhydride (400 g/l) and concentrated sulfuric acid (200 ml/l), after which the plate is directly strike-plated in an electrolytic copper plating bath containing copper sulfate (200 g/l) and concentrated sulfuric acid (50 g/l) under a current density of 1 $A/dm^2$, after which the current density is elevated to 3.5 $A/dm^2$ to effect electroplating. The results are shown in Table 1.

EXAMPLE 2

Except that the amount of the carbon black is altered to 8 parts, treatments are made in entirely the same manner as in Example 1 to obtain a flat plate. The intrinsic volume resistivity of the composition is 850 Ω.cm. Thereafter, the plating is made in the same manner as in Example 1. The results are shown in Table 1.

EXAMPLE 3

By the use of the same ABS resin as in Example 1 (100 parts) and a carbon black having the oil absorption amount of 200 ml/100 g and a surface area of 600 $m^2/g$ (40 parts), a flat plate is obtained in the same manner as in Example 1. The intrinsic volume resistivity of the composition is 35 Ω.cm. Thereafter, plating is effected in the same manner as in Example 1. The results are shown in Table 1.

Comparative Example 1

By the use of the same ABS resin as in Example 1 (100 parts) and a carbon black having an oil absorption amount of 95 ml/100 g and a surface area of 120 $m^2/g$ (150 parts), a flat plate is obtained in the same manner as in Example 1.

Due to the extremely large amount of use of the carbon black, the work at the time of the kneading is complicated, and moreover the flat plate is very fragile. Also, the intrinsic volume resistivity of the composition is 720 Ω.cm. Thereafter, plating is effected in the same manner as in Example 1. The results are shown in Table 1.

Comparative Example 2

Excepting the change of the amount of the carbon black to 40 parts, the treatment is made in entirely the same manner as in Comparative Example 1 to obtain a flat plate, which is then plated. The intrinsic volume resistivity of the composition is $1.8\times10^{10}$ Ω.cm. The results are shown in Table 1.

Comparative Example 3

By the use of the same ABS resin as in Example 1 (100 parts) and a carbon black having an oil absorption amount of 300 ml/100 g and the surface area of 350 $m^2/g$ (40 parts), treatment is made in the same manner as in Example 1 to obtain a flat plate, which is then plated. The intrinsic volume resistivity of the composition is $3.5\times10^6$ Ω.cm. The results are shown in Table 1.

Comparative Example 4

Excepting the change of the amount of carbon black to 2 parts, treatment is made in entirely the same manner as in Example 1 to obtain a flat plate, which is then plated. The intrinsic volume resistivity of the composition is $8.9\times10^5$ Ω.cm. The results are shown in Table 1.

Reference Example 1

By the use solely of the same ABS resin as in Example 1, there is made a flat plate, which is plated under a conventional plating method (surface adjustment—degreasing—etching—neutralizing—activating—sensitizing—electroless plating—electroplating). The intrinsic volume resistivity of the ABS resin is $5.3\times10^{15}$ Ω.cm. The results are shown in Table 1.

Table 1

| | Example 1 | Example 2 | Example 3 | Comparative Example 1 | Comparative Example 2 | Comparative Example 3 | Comparative Example 4 | Reference Example 1 |
|---|---|---|---|---|---|---|---|---|
| ABS resin | 100 | 100 | 100 | 100 | 100 | 100 | 100 | 100 |

Table 1-continued

| | Example 1 | Example 2 | Example 3 | Comparative Example 1 | Comparative Example 2 | Comparative Example 3 | Comparative Example 4 | Reference Example 1 |
|---|---|---|---|---|---|---|---|---|
| (parts) | | | | | | | | |
| Carbon black (parts) | 15 | 8 | 40 | 150 | 40 | 40 | 2 | — |
| Oil absorption amount (ml/100 g) | 350 | 350 | 200 | 95 | 95 | 300 | 350 | — |
| Surface area ($m^2/g$) | 1000 | 1000 | 600 | 120 | 120 | 350 | 1000 | — |
| Intrinsic volume resistivity ($\Omega \cdot cm$) | 17 | 850 | 35 | 720 | $1.8 \times 10^{10}$ | $3.5 \times 10^{6}$ | $8.9 \times 10^{7}$ | — |
| Appearance after plating | | Good | | Film obtained, but surface thereof being rough and poor quality | | Not electrocoated | | Good |
| Adhesion strength of electrocoated film (kg/cm) | 1.5 | 1.4 | 1.5 | 0.2 | — | — | — | — |

EXAMPLE 4

Table 2

| Run No. | 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|
| Thermoplastic resin | PP | PP | PP | PP | PP | PP | PP | PVC | PS | PC | PMMA | PSU | PE | PAc | PA | SAN | PPO | EVA |
| Parts | 100 | 100 | 100 | 100 | 100 | 100 | 100 | 100 | 100 | 100 | 100 | 100 | 100 | 100 | 100 | 100 | 100 | 100 |
| Carbon black Parts | 12 | 7 | 50 | 40 | 40 | 400 | 2 | 12 | 12 | 12 | 12 | 12 | 12 | 12 | 12 | 12 | 12 | 12 |
| Oil absorption amount (ml/100 g) | 350 | 350 | 200 | 95 | 300 | 95 | 350 | 350 | 350 | 350 | 350 | 350 | 350 | 350 | 350 | 350 | 350 | 350 |
| Surface area ($m^2/g$) | 1000 | 1000 | 600 | 120 | 350 | 1000 | 1000 | 1000 | 1000 | 1000 | 1000 | 1000 | 1000 | 1000 | 1000 | 1000 | 1000 | 1000 |
| Intrinsic volume resistivity of composition ($\Omega \cdot cm$) | 82 | 900 | 20 | $2.5 \times 10^{11}$ | $4.8 \times 10^{7}$ | $3.7 \times 10^{10}$ | $1.5 \times 10^{6}$ | 90 | 91 | 85 | 80 | 95 | 83 | 91 | 78 | 75 | 82 | 80 |
| Appearance after plating | Good | | | Not electrocoated | | | | Good | | | | | | | | | | |
| Adhesion strength of electrocoated film (kg/cm) | 1.9 | 1.7 | 1.6 | — | — | — | — | 2.1 | 1.8 | 1.9 | 1.8 | 1.9 | 1.8 | 1.9 | 1.8 | 1.9 | 2.0 | 1.9 |

Note:
Run Nos. 1 to 3 and 8 to 18 are within the scope of the invention and Run Nos. 4 to 7 are for comparison. In the above table, abbreviations for thermoplastic resins respectively indicate as follows: PP, polypropylene; PVC, polyvinyl chloride; PS, polystyrene; PC, polycarbonate; PMMA, methacrylic resin; PSU, polysulfone; PE, polyester; PAc, polyacetal; PA, polyamide; SAN, styrene-acrylonitrile copolymer; PPO, polyphenylene oxide; EVA, ethylene-vinyl acetate copolymer.

As shown in Table 2, the thermoplastic resin and the carbon black are kneaded in a Banbury mixer at 200° C. for 8 minutes to give a composition. Thereafter, a flat plate of 70 mm×140 mm×2 mm is molded from the composition, said flat plate is subjected to etching with an etching solution comprising chromic anhydride (30 g/l) and concentrated sulfuric acid (500 ml/l) at 75° C. for 10 minutes. Then, it is subjected to strike-plating in an electrolytic copper plating bath comprising copper sulfate (200 g/l) and sulfuric acid (50 g/l) under a current density of 1 A/dm$^2$, and further to regular plating under elevation of the current density to 3.5 A/dm$^2$.

EXAMPLE 5

Various kinds of thermoplastic resin mixtures and carbon black as shown in Tables 3 and 4 are kneaded in the same manner as in Example 4 to mold flat plates.

The resulting flat plates are subjected to etching in the same manner as in Example 4, and thereafter to strike-plating and regular plating.

Table 3

| Run No. | 1 | 2 | 3 | 4 |
|---|---|---|---|---|
| Thermoplastic resin mixture (parts) | | | | |
| PP | 80 | 20 | — | — |
| PE | 20 | 80 | — | — |
| PPO | — | — | 80 | 20 |
| 10 | — | — | 20 | 80 |
| Carbon black (parts) | 10 | 10 | 10 | 10 |
| Oil absorption amount (ml/100 g) | 350 | 350 | 350 | 350 |
| Surface area ($m^2/g$) | 1000 | 1000 | 1000 | 1000 |
| Intrinsic volume resistivity of composition ($\Omega \cdot cm$) | 84 | 88 | 85 | 90 |
| Appearance after plating | Good | | | |
| Adhesion strength of electrocoated film (kg/cm) | 2.0 | 2.0 | 2.0 | 1.9 |

Note:
Abbreviations for thermoplastic resins are same as in Table 2.

EXAMPLE 6

As shown in Table 5, the thermoplastic resin and the carbon black are kneaded with a Banbury mixer at 200° C. for 3 minutes to obtain a composition. Thereafter, the composition is molded into a flat plate of 70 mm×140 mm×2 mm, which is subjected to etching with an etching solution comprising chromic anhydride (30 g/l) and concentrated sulfuric acid (500 ml/l) at 75° C. for 10 minutes and to neutralizing with a neutralizer D-25 made by Okuno Chemical Industry Co., Ltd. Thereafter, the flat plate is subjected to strike-plating in an electrolytic copper plating bath comprising copper sulfate (200 g/l) and sulfuric acid (50 g/l) under a current density of 1 $A/dm^2$, and then to regular plating under the current density elevated to 3.5 $A/dm^2$.

Table 4

| Run No. | 1 | 2 | 3 | 4 | 5 | 6 | 7 | 8 | 9 |
|---|---|---|---|---|---|---|---|---|---|
| Thermoplastic resin mixture (parts) | | | | | | | | | |
| ABS | 80 | 50 | 40 | 50 | 50 | 70 | 70 | 50 | 50 |
| PC | 20 | — | — | — | — | 30 | 30 | — | — |
| PVC | — | 50 | — | — | 40 | — | — | 50 | 50 |
| PMMA | — | — | 60 | — | — | — | — | — | — |
| AS | — | — | — | 50 | — | — | — | — | — |
| EVA | — | — | — | — | 10 | — | — | — | — |
| Carbon black | | | | | | | | | |
| Parts | 10 | 10 | 10 | 10 | 10 | 10 | 10 | 10 | 2 |
| Oil absorption amount (ml/100 g) | 350 | 350 | 350 | 350 | 350 | 350 | 95 | 95 | 350 |
| Surface area ($m^2/g$) | 1000 | 1000 | 1000 | 1000 | 1000 | 120 | 1000 | 120 | 120 |
| Intrinsic volume resistivity ($\Omega \cdot cm$) | 95 | 91 | 80 | 75 | 82 | $3.5 \times 10^8$ | $2.1 \times 10^9$ | $5.3 \times 10^9$ | $7.9 \times 10^{12}$ |
| Appearance after plating | Good | | | | | Not electrocoated | | | |
| Adhesion strength of electrocoated film (kg/cm) | 2.0 | 1.9 | 2.0 | 1.8 | 1.9 | — | — | — | — |

Note:
Abbreviations for thermoplastic resins are same as in Table 2.

Table 5

| Run No. | 1 | 2 | 3 | 4 | 5 | 6 | 7 | 8 | 9 | 10 | 11 |
|---|---|---|---|---|---|---|---|---|---|---|---|
| Thermoplastic resin | ABS | ABS | PP | PP | PE | PVC | PS | PC | PMMA | PSU | PE |
| Parts | 100 | 100 | 100 | 100 | 100 | 100 | 100 | 100 | 100 | 100 | 100 |
| Carbon black | | | | | | | | | | | |
| Parts | 5 | 15 | 8 | 20 | 15 | 12 | 12 | 12 | 12 | 12 | 12 |
| Oil absorption amount (ml/100 g) | 350 | 350 | 300 | 200 | 300 | 350 | 350 | 350 | 350 | 350 | 350 |
| Surface area ($m^2/g$) | 1000 | 1000 | 600 | 1000 | 600 | 1000 | 1000 | 1000 | 1000 | 1000 | 1000 |
| Intrinsic volume resistivity ($\Omega \cdot cm$) | 980 | 75 | 950 | 98 | 250 | 91 | 90 | 83 | 80 | 95 | 83 |
| Appearance after plating | Good | | | | | | | | | | |
| Adhesion strength of electrocoated film (kg/cm) | 2.1 | 2.3 | 2.1 | 2.2 | 2.2 | 2.3 | 2.1 | 2.3 | 1.9 | 2.0 | 2.0 |

| Run No. | 12 | 13 | 14 | 15 | 16 | 17 | 18 | 19 | 20 | 21 |
|---|---|---|---|---|---|---|---|---|---|---|
| Thermoplastic resin | PAc | PA | SAN | PPO | EVA | ABS | ABS | PP | PP | PC |
| Parts | 100 | 100 | 100 | 100 | 100 | 100 | 100 | 100 | 100 | 100 |

Table 5-continued

| | | | | | | | | | | |
|---|---|---|---|---|---|---|---|---|---|---|
| Carbon black | | | | | | | | | | |
| Parts | 12 | 12 | 12 | 12 | 12 | 1 | 10 | 10 | 15 | 10 |
| Oil absorption amount (ml/100 g) | 350 | 350 | 350 | 350 | 350 | 350 | 95 | 350 | 95 | 95 |
| Surface area ($m^2/g$) | 1000 | 1000 | 1000 | 1000 | 1000 | 1000 | 1000 | 300 | 120 | 120 |
| Intrinsic volume resistivity (Ω · cm) | 91 | 78 | 75 | 82 | 80 | $2.3 \times 10^5$ | $5.3 \times 10^7$ | $7.2 \times 10^7$ | $2.7 \times 10^8$ | $9.5 \times 10^8$ |
| Appearance after plating | Good | | | | | Not electrocoated | | | | |
| Adhesion strength of electrocoated film (kg/cm) | 2.1 | 2.0 | 2.1 | 2.3 | 2.1 | — | — | — | — | — |

Note:
Abbreviations for thermoplastic resins are same as in Table 2.

EXAMPLE 7

Various kinds of the thermoplastic resin mixtures and the carbon black as shown in Tables 6 and 7 are kneaded in the same manner as in Example 6 to mold flat plates. Those flat plates are subjected to etching and neutralizing in the same manner as in Example 6, and then to strike-plating and regular plating.

Table 6

| Run No. | 1 | 2 | 3 | 4 |
|---|---|---|---|---|
| Thermoplastic resin mixture (parts) | | | | |
| PP | 70 | 30 | — | — |
| PE | 30 | 70 | — | — |
| PPO | — | — | 50 | 90 |
| PS | — | — | 50 | 10 |
| Carbon black (parts) | 10 | 10 | 10 | 10 |
| Oil absorption amount (ml/100 g) | 350 | 350 | 350 | 350 |
| Surface area ($m^2/g$) | 1000 | 1000 | 1000 | 1000 |
| Intrinsic volume resistivity of composition (Ω · cm) | 87 | 90 | 89 | 85 |
| Appearance after plating | Good | | | |
| Adhesion strength of electrocoated film | 2.2 | 2.2 | 2.3 | 2.2 |

Table 6-continued

| Run No. | 1 | 2 | 3 | 4 |
|---|---|---|---|---|
| (kg/cm) | | | | |

Note:
Abbreviations for thermoplastic resins are same as in Table 2.

Table 7

| Run No. | 1 | 2 | 3 | 4 | 5 | 6 | 7 | 8 | 9 |
|---|---|---|---|---|---|---|---|---|---|
| Thermoplastic resin mixture (parts) | | | | | | | | | |
| ABS | 80 | 50 | 40 | 50 | 50 | 80 | 80 | 50 | 50 |
| PC | 20 | — | — | — | — | 20 | 20 | — | — |
| PVC | — | 50 | — | — | 40 | — | — | 50 | 50 |
| PMMA | — | — | 60 | — | — | — | — | — | — |
| SAN | — | — | — | 50 | — | — | — | — | — |
| EVA | — | — | — | — | 10 | — | — | — | — |
| Carbon black | | | | | | | | | |
| Parts | 10 | 10 | 10 | 10 | 10 | 10 | 10 | 10 | 2 |
| Oil absorption amount (ml/100 g) | 350 | 350 | 350 | 350 | 350 | 350 | 95 | 95 | 350 |
| Surface area ($m^2/g$) | 1000 | 1000 | 1000 | 1000 | 1000 | 120 | 1000 | 120 | 120 |
| Intrinsic volume resistivity (Ω · cm) | 95 | 91 | 80 | 75 | 82 | $3.6 \times 10^8$ | $2.2 \times 10^9$ | $5.3 \times 10^9$ | $7.9 \times 10^{12}$ |
| Appearance after plating | Good | | | | | | Not electrocoated | | |
| Adhesion strength of electrocoated film (kg/cm) | 2.1 | 2.3 | 2.3 | 2.0 | 2.1 | — | — | — | — |

Note:
Abbreviations for thermoplastic resins are same as in Table 2.

EXAMPLE 8

Kralastic® MV (made by Sumitomo Naugatuck Co., Ltd.) as the ABS resin (100 parts) and the carbon black having an oil absorption amount of 350 ml/100 g and a surface area of 1000 $m^2/g$ (10 parts) are kneaded in a Banbury mixer at 220° C. for 12 minutes to obtain a composition having an intrinsic volume resistivity of 95 Ω.cm. From this composition a flat plate (70 mm × 140 mm × 2 mm) is molded. The resulting flat plate is degreased with a C-15 cleaner solution made by Okuno Chemical Industry Co., Ltd., subjected to etching with an etching solution comprising 30 g/l of chromic anhydride and 500 ml/l of concentrated sulfuric acid, neutralizing with a D-25 neutralizer made by Okuno Chemical Industry Co., Ltd., catalyst treatment with an A-30 catalyst solution made by Okuno Chemical Industry Co., Ltd., and accelerator treatment with a D-25 accelerator solution made by Okuno Chemical Industry Co., Ltd., followed by strike-plating in an electrolytic copper plating bath comprising 200 g/l of copper sulfate and 50 g/l of sulfuric acid with a current density of 1 A/dm$^2$ and regular plating with a current density of 3.5 A/dm$^2$.

EXAMPLE 9

Excepting the change of the amount of the carbon black to 8 parts, treatments are made in the same manner as in Example 8 to obtain a flat plate. The intrinsic volume resistivity of the composition is 850 Ω.cm. Thereafter, plating is made in the same manner as in Example 8. The results are shown in Table 8.

EXAMPLE 10

By the use of the same ABS resin as in Example 8 (100 parts) and the carbon black having an oil absorption amount of 200 ml/100 g and the surface area of 600 m$^2$/g (40 parts), a flat plate is obtained in the same manner as in Example 8. The intrinsic volume resistivity of the composition is 35 Ω.cm. Thereafter, plating is made in the same manner as in Example 8. The results are shown in Table 8.

Comparative Example 5

By the use of the same ABS resin as in Example 8 (100 parts) and the carbon black having an oil absorption amount of 95 ml/100 g and the surface area of 120 m$^2$/g (150 parts), a flat plate is obtained in the same manner as in Example 8. Due to the extremely large amount of carbon black used, the work in kneading is complicated, and moreover the flat plate is extremely fragile. The intrinsic volume resistivity of the composition is 720 Ω.cm. Thereafter, plating is made in the same manner as in Example 8. The results are shown in Table 8.

Comparative Example 6

Excepting the change of the amount of the carbon black to 40 parts, entirely the same steps as in Comparative Example 5 are adopted to obtain a flat plate, which is then plated. The intrinsic volume resistivity of the composition is $1.8\times10^{10}$ Ω.cm. The results are shown in Table 8.

Comparative Example 7

The same ABS resin as in Example 8 (100 parts) and the carbon black having the oil absorption amount of 300 ml/100 g and a surface area of 350 m$^2$/g (40 parts) are used to obtain a flat plate in the same manner as in Example 8, and said flat plate is plated. The intrinsic volume resistivity of the composition is $3.5\times10^6$ Ω.cm. The results are shown in Table 8.

Comparative Example 8

Excepting the change of the amount of the carbon black to 2 parts, entirely the same steps as in Example 8 are adopted to obtain a flat plate, which is then plated. The intrinsic volume resistivity of the composition is $8.9\times10^5$ Ω.cm. The results are shown in Table 8.

Reference Example 2

By the use solely of the same ABS resin as in Example 8, there is made a flat plate, which is plated in a conventional plating method (surface adjustment—degreasing—etching—neutralizing—activating—sensitizing—electroless plating). The results are shown in Table 8.

Table 8

| | Example 8 | Example 9 | Example 10 | Comparative Example 5 | Comparative Example 6 | Comparative Example 7 | Comparative Example 8 | Reference Example 2 |
|---|---|---|---|---|---|---|---|---|
| ABS resin | 100 | 100 | 100 | 100 | 100 | 100 | 100 | 100 |
| Carbon black | 10 | 8 | 40 | 150 | 40 | 40 | 2 | — |
| Oil absorption amount (ml/100 g) | 350 | 350 | 200 | 95 | 95 | 300 | 350 | — |
| Surface area (m$^2$/g) | 1000 | 1000 | 600 | 120 | 120 | 350 | 1000 | — |
| Intrinsic volume resistivity (Ω · cm) | 95 | 850 | 35 | 720 | $1.8\times10^{10}$ | $3.5\times10^6$ | $8.9\times10^7$ | — |
| Appearance after plating | | Good | | Film obtained, but surface thereof being rough and low quality | | Not electrocoated | | Good |
| Adhesion strength of electrocoated film (kg/cm) | 1.5 | 1.4 | 1.5 | 0.2 | — | — | — | 1.5 |

EXAMPLE 11

As shown in Table 9, the thermoplastic resin and the carbon black are kneaded with a Banbury mixer at 200° C. for 8 minutes to obtain a composition. Thereafter, from the composition there is molded a flat plate of 70 mm×140 mm×2 mm, which is dipped in an aqueous dispersion comprising 200 ml/l of toluene and 100 ml/l of trichloroethylene at 60° C. for 10 minutes to effect preliminary etching. Further, the composition is rinsed in a warm aqueous solution containing turpentine (60%) and surface active agent (20%) at 75° C. for 15 minutes, subjected to etching with an etching solution comprising 30 g/l of chromic anhydride and 500 ml/l of concentrated sulfuric acid at 75° C. for 10 minutes, neutralizing with a neutralizer D-25 made by Okuno Chemical Industry Co., Ltd., catalyst treatment with a catalyst A-30 made by Okuno Chemical Industry Co., Ltd. and accelerator treatment with an accelerator solution D-25 made by Okuno Chemical Industry Co., Ltd., followed by strike-plating in an electrolytic copper plating bath comprising 200 g/l of copper sulfate and 50 g/l of sulfuric acid at a current density of 1 A/dm$^2$ and regular plating at a current density to 3.5 A/dm$^2$.

To Run Nos. 1 to 7 and 13 wherein polypropylene and polyester are used, there are applied sensitizing with a TMP sensitizer made by Okuno Chemical Industry Co., Ltd. instead of the catalyst treatment and activating with a TMP activator made by Okuno Chemical Industry Co., Ltd. instead of the accelerator treatment.

Table 9

| Run No. | 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|
| Thermoplastic resin | PP | PP | PP | PP | PP | PP | PP | PVC | PS | PC | PMMA | PSU | PE | PAc | PA | SAN | PPO | EVA |
| Parts | 100 | 100 | 100 | 100 | 100 | 100 | 100 | 100 | 100 | 100 | 100 | 100 | 100 | 100 | 100 | 100 | 100 | 100 |
| Carbon black Parts | 12 | 7 | 50 | 40 | 40 | 400 | 2 | 12 | 12 | 12 | 12 | 12 | 12 | 12 | 12 | 12 | 12 | 12 |
| Oil absorption amount (ml/100 g) | 350 | 350 | 200 | 95 | 300 | 95 | 350 | 350 | 350 | 350 | 350 | 350 | 350 | 350 | 350 | 350 | 350 | 350 |
| Surface area (m$^2$/g) | 1000 | 1000 | 600 | 120 | 350 | 1000 | 1000 | 1000 | 1000 | 1000 | 1000 | 1000 | 1000 | 1000 | 1000 | 1000 | 1000 | 1000 |
| Intrinsic volume resistivity of composition (Ω · cm) | 82 | 900 | 20 | $2.5\times10^{11}$ | $4.8\times10^{7}$ | $3.7\times10^{10}$ | $1.5\times10^{6}$ | 90 | 91 | 85 | 80 | 95 | 83 | 91 | 78 | 75 | 82 | 80 |
| Appearance after plating | | Good | | | Not electrocoated | | | | | | | | Good | | | | | |
| Adhesion strength of electrocoated film (kg/cm) | 2.0 | 1.6 | 1.5 | — | — | — | — | 2.2 | 1.9 | 1.9 | 1.8 | 2.0 | 1.9 | 2.0 | 1.8 | 1.9 | 2.2 | 1.9 |

Note:
Run Nos. 1 to 3 and 8 to 18 are within the scope of the invention and Run Nos. 4 to 7 are for comparison.
Abbreviations for thermoplastic resins are same as in Table 2.

EXAMPLE 12

As shown in Tables 10 and 11, various kinds of thermoplastic resin mixtures and carbon black are kneaded in the same manner as in Example 11 to mold flat plates. Those flat plates are subjected to etching, neutralizing, sensitizing and activating treatments (as to Table 11, catalyst and accelerator treatments) and thereafter to strike-plating and regular plating.

Table 10

| Run No. | 1 | 2 | 3 | 4 |
|---|---|---|---|---|
| Thermoplastic resin mixture (parts) | | | | |
| PP | 80 | 20 | — | — |
| PE | 20 | 80 | — | — |
| PPO | — | — | 80 | 20 |
| PS | — | — | 20 | 80 |
| Carbon black (parts) | 10 | 10 | 10 | 10 |
| Oil absorption amount (ml/100 g) | 350 | 350 | 350 | 350 |
| Surface area (m$^2$/g) | 1000 | 1000 | 1000 | 1000 |
| Intrinsic volume resistivity of composition (Ω · cm) | 84 | 88 | 85 | 90 |
| Appearance after plating | | Good | | |
| Adhesion strength of electrocoated film (kg/cm) | 2.1 | 2.0 | 2.0 | 2.0 |

Note:
Abbreviations for thermoplastic resins are same as in Table 2.

Table 11

| Run No. | 1 | 2 | 3 | 4 | 5 | 6 | 7 | 8 | 9 |
|---|---|---|---|---|---|---|---|---|---|
| Thermoplastic resin mixture (parts) | | | | | | | | | |
| ABS | 80 | 50 | 40 | 50 | 50 | 70 | 70 | 50 | 50 |
| PC | 20 | — | — | — | — | 30 | 30 | — | — |
| PVC | — | 50 | — | — | 40 | — | — | 50 | 50 |
| PMMA | — | — | 60 | — | — | — | — | — | — |
| SAN | — | — | — | 50 | — | — | — | — | — |
| EVA | — | — | — | — | 10 | — | — | — | — |
| Carbon black | | | | | | | | | |
| Parts | 10 | 10 | 10 | 10 | 10 | 10 | 10 | 10 | 2 |
| Oil absorption amount (ml/100 g) | 350 | 350 | 350 | 350 | 350 | 350 | 95 | 95 | 350 |
| Surface area (m$^2$/g) | 1000 | 1000 | 1000 | 1000 | 1000 | 120 | 1000 | 120 | 120 |
| Intrinsic volume resistivity (Ω · cm) | 95 | 91 | 80 | 75 | 82 | $3.5\times10^{8}$ | $2.1\times10^{9}$ | $5.3\times10^{9}$ | $7.9\times10^{12}$ |
| Appearance after plating | | | Good | | | | Not electrocoated | | |

Table 11-continued

| Run No. | 1 | 2 | 3 | 4 | 5 | 6 | 7 | 8 | 9 |
|---|---|---|---|---|---|---|---|---|---|
| Adhesion strength of electrocoated film (kg/cm) | 1.9 | 2.0 | 2.1 | 1.9 | 1.9 | — | — | — | — |

Note:
Abbreviations for thermoplastic resins are same as in Table 2.

What is claimed is:

1. A method for preparation of a plated product which comprises electroplating a molded product of a resin composition consisting essentially of at least one kind of thermoplastic resin and carbon black having an oil absorption amount of not less than 200 ml/100 g and a surface area of not less than 500 $m^2/g$ in a weight proportion of 100:3–100 and having an intrinsic volume resistivity of not more than $10^3$ Ω.cm without previous electroless plating.

2. The method according to claim 1, wherein the thermoplastic resin is a copolymer of vinyl cyanide, an aromatic vinyl compound and a conjugated diene rubber.

3. The method according to claim 1, wherein the thermoplastic resin is polypropylene.

4. The method according to claim 1, wherein the thermoplastic resin is polyethylene.

5. The method according to claim 1, wherein the thermoplastic resin is a homopolymer or copolymer of vinyl chloride.

6. The method according to claim 1, wherein the thermoplastic resin is polystyrene.

7. The method according to claim 1, wherein the thermoplastic resin is polycarbonate.

8. The method according to claim 1, wherein the thermoplastic resin is a methacrylic resin.

9. The method according to claim 1, wherein the thermoplastic resin is polysulfone.

10. The method according to claim 1, wherein the thermoplastic resin is polyacetal.

11. The method according to claim 1, wherein the thermoplastic resin is polyamide.

12. The method according to claim 1, wherein the thermoplastic resin is an aromatic vinyl compound-vinyl cyanide resin.

13. The method according to claim 1, wherein the thermoplastic resin is polyphenylene oxide.

14. The method according to claim 1, wherein the thermoplastic resin is an ethylene-vinyl acetate copolymer.

15. The method according to claim 1, wherein the thermoplastic resin is a resin comprising a mixture of polyphenylene oxide resin and polystyrene.

16. The method according to claim 1, wherein the thermoplastic resin is a resin comprising a mixture of polypropylene and polyethylene.

17. The method according to claim 1, wherein the thermoplastic resin is a mixture of a copolymer of vinyl cyanide, an aromatic vinyl compound and a conjugated diene rubber and one or more kinds of homopolymer and copolymers of vinyl chloride, polycarbonate, methacrylic resins, polysulfone, polyacetal, aromatic vinyl compound-vinyl cyanide copolymer and polyphenylene oxide.

18. The method according to claim 1, wherein the weight proportion of the thermoplastic resin and the carbon black is 100:5–70.

19. The method according to claim 1, wherein the intrinsic volume resistivity is not more than $10^2$ Ω.cm.

20. The method according to claim 1, wherein the electroplating is applied to the molded product after the step of etching.

21. The method according to claim 1, wherein the electroplating is applied to the molded product after the steps of etching and neutralizing.

22. The method according to claim 1, wherein the electroplating is applied to the molded product after the steps of etching, neutralizing, catalyst treatment and accelerator treatment.

23. The method according to claim 1, wherein the electroplating is applied to the molded product after the steps of etching, neutralizing, sensitizing and activating.

* * * * *